United States Patent [19]

Nakagawa et al.

[11] Patent Number: 4,728,467

[45] Date of Patent: Mar. 1, 1988

[54] INNER AIR VENT SYSTEMS FOR FLOAT CHAMBERS IN CARBURETORS

[75] Inventors: Tomozo Nakagawa; Naotake Nii, both of Akashi; Kozo Watanabe, Ono, all of Japan

[73] Assignee: Kawasaki Jukogyo Kabushiki Kaisha, Japan

[21] Appl. No.: 17,556

[22] Filed: Feb. 24, 1987

[30] Foreign Application Priority Data

Mar. 3, 1986 [JP] Japan ..... 61-30395[U]

[51] Int. Cl.[4] ..... F02M 5/08

[52] U.S. Cl. ..... 261/72.1; 261/DIG. 67; 55/DIG. 28

[58] Field of Search ..... 261/72.1, DIG. 67; 55/DIG. 28

[56] References Cited

U.S. PATENT DOCUMENTS

| | | | |
|---|---|---|---|
| 2,153,069 | 4/1939 | Barr et al. | 55/DIG. 28 |
| 2,921,775 | 1/1960 | Moseley | 261/72.1 |
| 3,194,224 | 7/1965 | Lechtenberg et al. | 55/DIG. 28 |
| 3,778,024 | 12/1973 | Rogerson | 261/DIG. 67 |
| 4,134,378 | 1/1979 | Kingsley | 261/DIG. 67 |
| 4,233,043 | 11/1980 | Catterson | 55/DIG. 28 |

*Primary Examiner*—Tim Miles

*Attorney, Agent, or Firm*—Eric P. Schellin

[57] ABSTRACT

An inner air vent system for internal combustion engines is disclosed which prevents accidental flush of fuel from the float chamber into the venturi tube of the carburetor as when the vehicle is running on a steep slope or extremely rough surface. The inner air vent system comprises an air passage axially defined in the mounting bosses of the air cleaner, air intake pipe and carburetor, with the air cleaner being located above the carburetor. The air passage has a lower end thereof opened into the air gap inside the float chamber. With this arrangement, tilt of the vehicle even into an extreme position is unlikely to permit the flow of fuel from the float chamber into the carburetor venturi tube, because of the air passage having its upper opening held high enough above the fuel level in the float chamber. Furthermore, the inner air vent system can be constructed without the addition of extra joints and piping work, there is no significant increase in assembling cost. In addition, the system is very simple in structure, it can be incorporated in a small, lightweight engine.

1 Claim, 4 Drawing Figures

INNER AIR VENT SYSTEMS FOR FLOAT CHAMBERS IN CARBURETORS

BACKGROUND OF THE INVENTION (1) Field of the Invention

This invention relates in general to a float chamber for carburetors and, in more particular, to an inner air vent system for maintaining the float chamber under a positive pressure relative to the throat of the carburetor venturi.

(2) Description of the Prior Art

In the prior art, various types of float chambers for carburetors have been developed and used. In basic carburetor designs, the float chamber is connected through a fuel passage to the fuel jet located in the venturi of the carburetor for delivery of fuel to the engine. The fuel in the float chamber is maintained at a constant level, with the tip of the fuel jet being held to stand slightly above the float chamber fuel level maintaining a level difference enough to allow the controlled discharge of fuel, but without spilling, from the fuel jet where a slight vacuum is created by the air flow through the venturi. Thus, float chambers are provided with air vents to admit atmospheric air into the space above the fuel in the float chamber.

Some of the conventional float chambers are equipped with an outer vent, as represented by the art proposed in Japanese laid-open utility model application No. 57-43071, that directly opens into the top space of the float chamber exposing the fuel to atmospheric air. These float chamber structures have been found to have the disadvantage of permitting entrance of foreign matter into the float chamber with the influx of air.

To eliminate the above-mentioned difficulty, various improvements have so far been developed. One such an example is an inner air vent system which consists of an air passage having its one end opened into the air space in the top of the closed float chamber and its other end connected to the air intake pipe for the carburetor to admit air, cleaned by the air cleaner, into the float chamber, as taught in Japanese published patent application No. 60-33991.

There has recently been increasing demand on the development of a smaller, more lightweight engine. However, minituarization has somewhat been discouraged by the modern inner air vent carburetor designs that the air intake pipes are located to stand close to the top portion of the float chambers making it rather impossible to insure a required difference of height between the fuel level in the float chamber and the opened tip of the air passages for proper fuel discharge. Furthermore, where the vehicle has to be operated on an extremely rough surface or run on a steep slope, the conventional techniques are altogether incapable of preventing gravitational flush of fuel from the float chamber into the carburetor venturi through the air vent passage due to the inclined engine body resulting in abnormal combustion in the cylinders.

The present invention has been proposed to eliminate these difficulties of the prior art inner air vent float chambers.

SUMMARY OF THE INVENTION

It is therefore a primary object of the present invention to provide an improved inner air vent system for float chambers of the type having means to receive the carburetor air intake pipe fresh air cleaned by the air cleaner, which prevents gravitational flush of fuel from the float chamber into the venturi thereby eliminating the conventional problem of abnormal combustion in the engine cylinders.

The above and other objects, features and advantages of the present invention are achieved by the inner air vent system comprising an air passage that has its lower end connected to the air space of the float chamber through its top wall and its upper end connected to open through the carburetor air intake pipe into the outlet of the air cleaner located above the carburetor, with the air passage being defined within the mounting bosses of the air cleaner, air intake pipe, and carburetor.

DETAILED DESCRIPTION OF PREFERRED EMBODIMENTS

The preferred embodiment of the present invention will be described in great detail in conjunction with the attached drawings.

Figure 1:
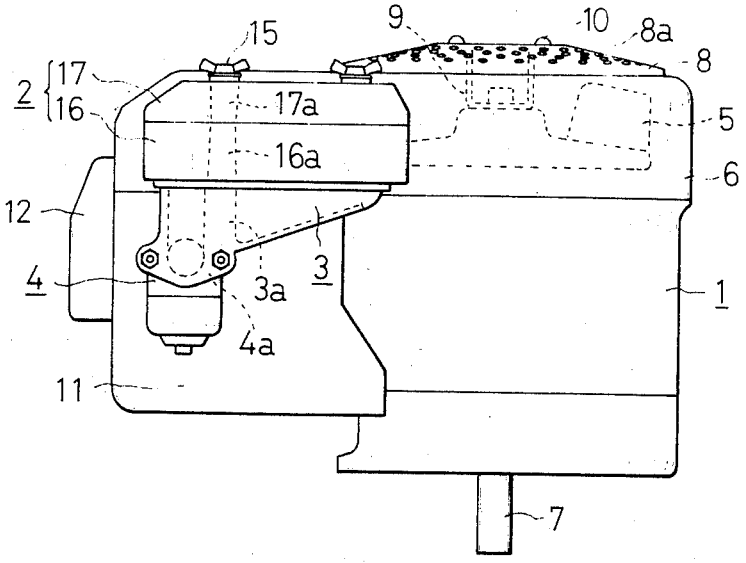
FIG. 1 is a side view of the overall construction of an engine having the inner air vent system according to the present invention.

Referring to FIG. 1, an internal combustion engine 1 includes an air cleaner 2, an air intake pipe 3, and a carburetor 4. A cooling fan 5 is connected to the one end of a crankshaft (not shown), encased in a fan housing 6 mounted on the engine 1. To the opposite end of the crankshaft is connected an output shaft 7 to transmit the engine torque to a transmission system (not shown). A rotary screen 8 is connected to the cooling fan 5 through a stay 9 and an attaching bolt 10 for rotation with the cooling fan and provided with a plurality of holes **8*a* to permit entrance of atmospheric air as the cooling fan rotates for cooling the engine 1 and associated parts. A guide plate 11 is provided located on the downstream side of the cooling fan 5 to guide the flow of air taken into the fan housing 6 toward the cylinder head 12 of the engine 1**.

Figure 2:
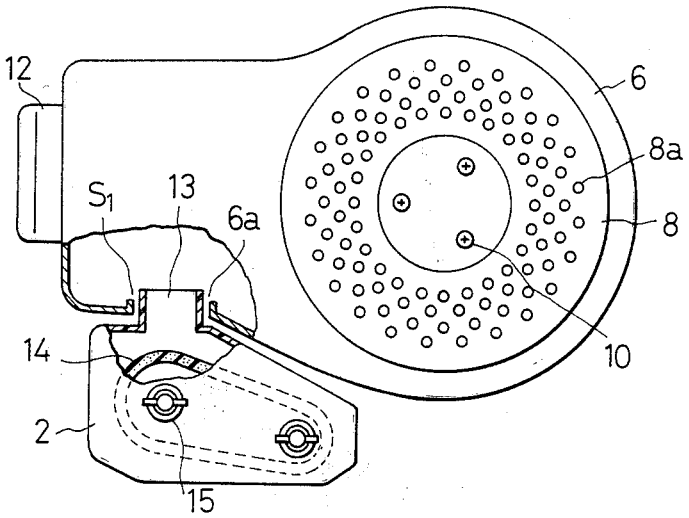
FIG. 2 is a plan view of FIG. 1, with portion removed to disclose the inside.

With respect to FIG. 2, the air cleaner 2 is provided with an air inlet pipe 13 that extends into the fan housing 6 through an aperture **6*a* formed in the side walls thereof. Preferably, the aperture 6*a* is made larger in diameter than the air inlet pipe 13 to allow an annular gap S1 about the outside circumference of the air inlet pipe 13. Also, the air cleaner 2 carries therein an endless band of filter element 14** through which the air from the fan housing is passed from outside to inside to remove the dust and dirt contained in the air.

Figure 3:
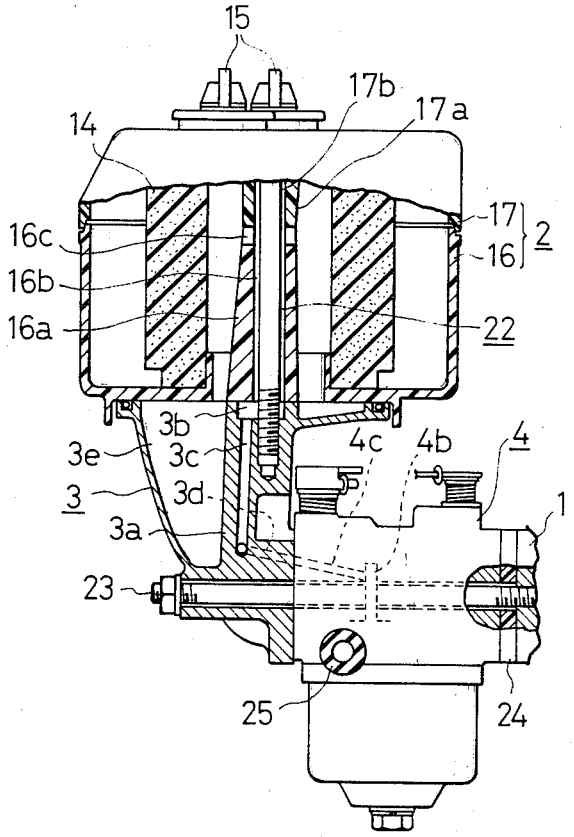
FIG. 3 is a vertical cross-sectional view of the important portion of FIG. 1.

In FIG. 3, which shows the important portion of this invention, the air cleaner 2 consists of a shroud 16 and a top lid 17 supported on a vertical pair of coaxial mounting bosses **16*a* and 17*a*, respectively. Also, a pair of axially aligned air passages 16*b* and 17*b* are defined within the paired mounting bosses 16*a* and 17*b*. A wing bolt 15 is provided, loosely inserted into the paired air passages 16*b* and 17*b* enough to permit passage of air therethrough. Also, the wing bolt 15 is connected at its lower end portion to a mounting boss 3*a* for an air intake pipe 3, which is located below the boss 16*a***, securing the air cleaner 2 in fixed position. A communicating passage 16c is provided mounted in the boss 16a to interconnect the air passages 16b and 17b.

Connected to the lower end of the air passage 16a is an annular air passage 3b defined about the lower threaded end of the wing bolt 15 through a top portion of the mounting boss 3a of the air intake pipe 3. Also, an air passage 3b is axially defined in the boss 3a and connected to the lower end of the annular air passage 3b. An inclined air passage 3d is provided connected to a lower portion of the air passage 3c. The air passage 3d is adapted for supplying the carburetor 4 with air conducted through the air passage 3c.

Figure 4:
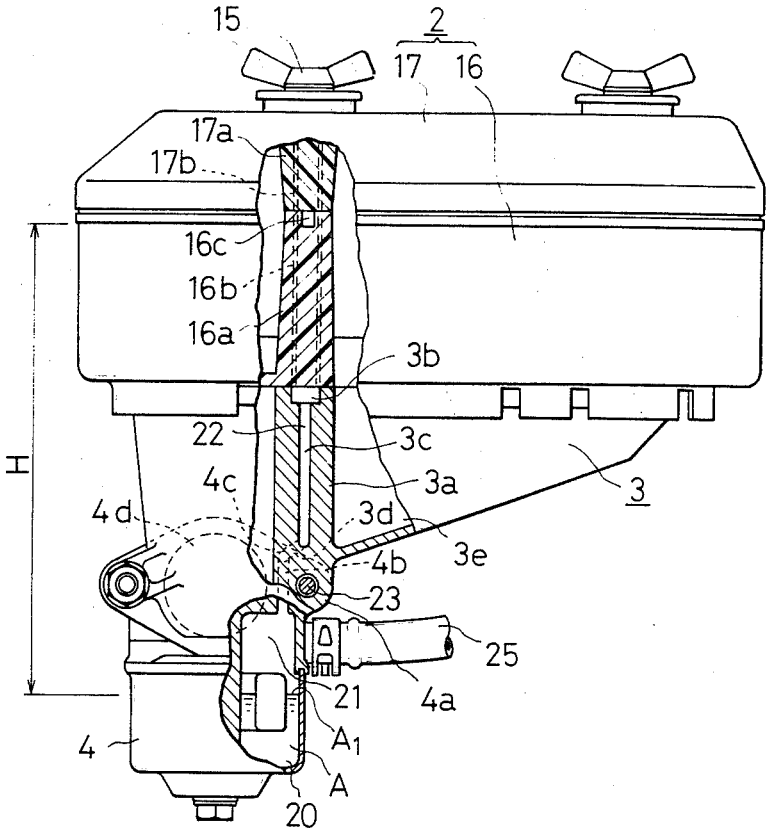
FIG. 4 is a side view of FIG. 3, with portion removed to disclose the inside.

Referring then to FIG. 4, the carburetor 4 is supported on a mounting boss 4a in which a vertical air passage 4b is defined. The air passage 4b is connected to a float chamber 20 having therein an air space 21 into which the air passage 4b opens. An inclined air passage 4c is connected at one end thereof to the air passage 3d and at its other end to the vertical air passage 4b through an upper portion thereof thereby establishing an air-flow relationship between the air space 21 of the float chamber 20 and an inner air vent system comprising in combination the paired air passages 16c and 16b in the air cleaner shroud boss 16a, the air passages 3b and 3c in the air intake pipe boss 3a, the inclined air passages 3d and 4c, and the vertical air passage 4b. Thus, air introduced by the cooling fan 5 and cleaned by the filter element 14 is admitted to the float chamber 20.

The air cleaner 2 and air intake pipe 3 integrated together by the wing bolt 15 is secured, together with the carburetor 4 and an insulator 24, to the engine body 4 through a long bolt 23. As illustrated, the cleaner 2 is located above the carburetor 4, with the former being connected to the air passage 4d of the latter located downstream of the filter element 14. Also, the float chamber 20 is supplied with fuel from a fuel tank, not shown, through a fuel supply pipe 25.

Since the system of the present invention has been explained, operation of the system with the engine 1 running will be described to provide a better understanding of the invention.

With the start of the engine 1, the cooling fan 5, along with the rotary screen 8, starts running admitting air to the fan housing 6 through the holes 8a which removes the larger particles of foreign matter contained in the air. A part of the air thus introduced is conducted along the surface of the guide plate 11 to move toward the cylinder head 12 and engine cylinders, not shown, for cooling while the remaining part being admitted into the air cleaner 2 through the air inlet pipe 13. The air through the air cleaner 2 is then cleared of the smaller particles of foreing matter as it is passed through the filter element 14, and flows through the air passage 3e of the air intake pipe 3 into the air passage 4d of the carburetor. As the air moves past the narrow throat of the air passage 4d, a slight vacuum is created, due to the venturi effect, drawing fuel A in atomized form from the tip of the fuel nozzle, not shown, that is in fluid-flow relationship with the float chamber 20 to receive fuel therefrom.

Since the float chamber 20 has also its air space 21 placed open to atmosphere through the inner air vent system, as described in connection with FIGS. 3 and 4, the fuel in the float chamber is under constant atmospheric pressure, with the fuel level being maintained at a constant hight slightly below the tip of the fuel jet, so that continuous fuel discharge is sustained in the air passage 4d of the carburetor 4. Because of the design that the air space 21 of the float chamber 20 is connected downstream of the filter element 14, no foreign matter is likely to be admitted to contaminate the fuel.

Furthermore, in according with the present invention, the inner air vent system 22, only through which the float chamber 20 has its air space 21 opened to the atmosphere, is disposed to extend upward far above the carburetor 4 to provide a difference I, as measured from the constant fuel level A1 in the float chamber 20 to the uppermost end of the air passage 16c constituting part of the inner air vent system. The difference I should be such that tilting the engine 1, as when the vehicle is running on an inclined surface, is unlikely to result in the fuel entering the inner air vent system 22 so that the cylinders are fed with excessive fuel into abnormal combustion.

In addition, an inner air vent system 22 in accordance with the present invention can be constructed at minimum cost since it require no special joints and piping work. This is because that the system 22, as stated above, comprises the air passages 16b and 16c defined in the air cleaner bosses 16a and 17a, the air passages 3b and 3c formed in the air intake pipe boss 3a, and the ones in the carburetor boss 4a. Furthermore, the incorporation of the system 22 would add no significant weight or increase overall engine size, without complicating general engine assembling. Additionally, since the bosses 16a, 17a, 3a and 4a are generally of thick construction, no difficulty would be encountered in drilling an axial air passage in them.

Furthermore, in this particular embodiment, the downward inclination of the air passages 3d and 4c between the air intake pipe 3 and carburetor 4 is intended to allow the return into the carburetor air passage 4d of fuel that might enter the inner air vent system 22 as a result of the engine 1 turning into an extremely tilted position or percolation.

The air entering the air cleaner 2 will be increased in pressure by the cooling fan 5 to a magnitude that is determined by the location of the guide plate 11, the size of the cooling fan 5, its capacity, and the gap Sl between the aperture 6a and air inlet pipe 13. Since delicate pressure equilibrium has to be maintained between the air space 21 of the float chamber 20 and the air passage 4d of the carburetor 4, any deviation from design in one or more of these factors during assembly or use can lead to serious consequences. According to the present invention, the inner air vent system 22 is so connected that the air space 21 is subject to the same pressure as the air passage 4d, required pressure equilibrium can always be sustained whatever deviation may be in the designs of the foregoing factors.

In the construction of an internal combustion engine with an inner air vent system according to the present invention, the various air passages 17b, 16b, 16c, 3b, 3c, 3d, 4b and 4c of the system may be formed when their respective boss is assembled into the cleaner top lid 17, cleaner shroud 16, air intake pipe 3, or carburetor 4.

It will be easily appreciated from the above that the inner air vent system of this invention can accomplish the above-mentioned and other objectives.

What is claimed is:

1. In an internal combustion engine for vehicles including an air cleaner, an air intake pipe for supplying atmospheric air through said air cleaner to said engine, a carburetor, and a float chamber for supplying fuel to said carburetor, said air cleaner being mounted above said carburetor, said air cleaner, said air intake pipe and said carburetor being supported on a train of connected mounting bosses, respectively, an inner air vent system comprising an air passage defined in said mounting bosses and connected between said air cleaner and carburetor, said air passage having a lower end opened into the air space in said float chamber, thereby subjecting both said air space of said float chamber and the venturi tube of said carburetor to the downstream side of said air cleaner.

* * * * *